US005918650A

United States Patent [19]

Borden

[11] Patent Number: 5,918,650

[45] Date of Patent: Jul. 6, 1999

[54] LIQUID TRANSFER TOOL

[76] Inventor: Teddy H. Borden, 315 W. Braeside, Arlington Heights, Ill. 60004

[21] Appl. No.: 08/934,165

[22] Filed: Sep. 19, 1997

[51] Int. Cl.[6] ..... B65B 1/04

[52] U.S. Cl. ..... 141/383; 141/319; 141/363; 141/364; 141/365; 141/366

[58] Field of Search ..... 141/273, 319, 141/363, 364, 365, 366, 383, 386; 285/321, 332, 355, 390

[56] References Cited

U.S. PATENT DOCUMENTS 1,218,359 3/1917 Beatty ..... 285/390
1,589,781 6/1926 Anderson ..... 285/355
3,144,262 8/1964 Reynolds ..... 285/321

*Primary Examiner*—David J. Walczak
*Assistant Examiner*—Timothy L. Maust
*Attorney, Agent, or Firm*—Michael J. Femal

[57] ABSTRACT

A liquid transfer tool allows a nearly empty plastic bottle to be emptied into another bottle that is to be saved. Shampoos and other liquid like perfume are very expensive and users of these products want to save every last drop in a bottle. The handy screw on caps include a mating portion that allows a user to screw both caps onto the bottles to be joined together for salvaging the fluid of the more empty bottle into the bottle that is more full through either a snap fit or male and female mating threads.

7 Claims, 2 Drawing Sheets

LIQUID TRANSFER TOOL

TECHNICAL FIELD

The invention relates generally to a liquid transfer system, and more particularly to a liquid transfer system for bottles having a multiplicity of different thread sizes on opposing mating caps that joins different bottles containing various levels of similar liquids so that the bottle on top drains into the bottle on the bottom by gravity.

BACKGROUND ART

Consumers today pay considerable sums of money for shampoos, liquid cleaning detergents, perfumes and other liquid products generally contained within glass or plastic bottles. The present day consumer often wants to save the remaining liquid in these containers by draining them into another bottle that is nearly full or partially empty. In addition, bottles containing the same liquid are often of different sizes like economy, family or jumbo which have different size necks on them that make it difficult to pour form one bottle into another without spilling some of the liquid. Other liquid transfer devices often did not provide a simple but secure connection that allows the easy transfer of the remnants of liquid from one bottle to another that was easy to attach to the necks of the bottles and still provided a secure connection that did not spill the liquid being transferred.

SUMMARY OF THE INVENTION

Accordingly, an important object of the present invention is to provide a liquid transfer system for bottles that includes a simple connective connection between one bottle to another for the transfer of liquids without spilling the same.

A further object of the invention is to provide a sturdy, portable, easily manipulated and applied device that fits securely onto a multitude of bottle necks of varying dimensions for transferring the remnants of liquid in one bottle into another bottle in an attempt to save the remaining liquid in a nearly empty bottle.

Another object of the invention is to provide a liquid transfer tool that combines a simple two piece construction whereby each piece screws onto the respective necks of bottles to be connected together and then snap together to form a sealed path between the bottles for transferring the remnants of the liquid from the nearly empty bottle into the bottle to be saved.

In the preferred embodiment of the invention, the invention is comprised of a two piece liquid transferring tool having a first piece with a bottle cap end for screwing onto the neck threads of a first bottle to be emptied and with a generally truncated cone shaped male end extending from the cap end including an annular exterior rib located at predetermined distance from the tip of the male end and a coaxial passage with the bottle cap end for transferring fluids therethrough and having a second piece with a bottle cap end for screwing onto the neck threads of a second bottle to be filled with the remnants of the liquid from the first bottle and an inverted truncated female end protruding like a funnel into the cap end including a locking groove located at a predetermined distance within the female end for snap locking the rib of the first piece to the locking groove of the second piece to form a sealed path between the bottles for transferring the liquid remnants from the first bottle to be emptied into the second bottle to be saved.

A second embodiment of the invention comprises a two piece liquid transferring tool having a first piece with a bottle cap end with internal conical threads for screwing onto external conical neck threads of one bottle including a generally truncated cone shaped male end with external conical threads extending above the cap end, said male end integral with the cap end to form a coaxial passage for liquids and having a second piece with a bottle cap end with internal conical threads for screwing onto external conical neck threads of another bottle to be joined to the one bottle including a generally inverted truncated female end extending above the cap end having internal conical thread for screwingly engaging the male end of the first piece to form a sealable pathway between the respective bottles during the transfer of the remnants of liquid from one bottle to the other.

Other features and advantages of the invention, which are believed to be novel and nonobvious, will be apparent from the following specification taken in conjunction with the accompanying drawings in which there is shown both embodiments of the invention. Reference is made to the claims for interpreting the full scope of the invention, which is not necessarily represented by any one embodiment.

DETAILED DESCRIPTION

Although this invention is susceptible to embodiments of many different forms, two different embodiments will be described and illustrated in detail herein. The present disclosure exemplifies the principles of the invention and is not to be considered a limit to the broader aspects of the invention to the particular embodiments as described.

Figure 1:
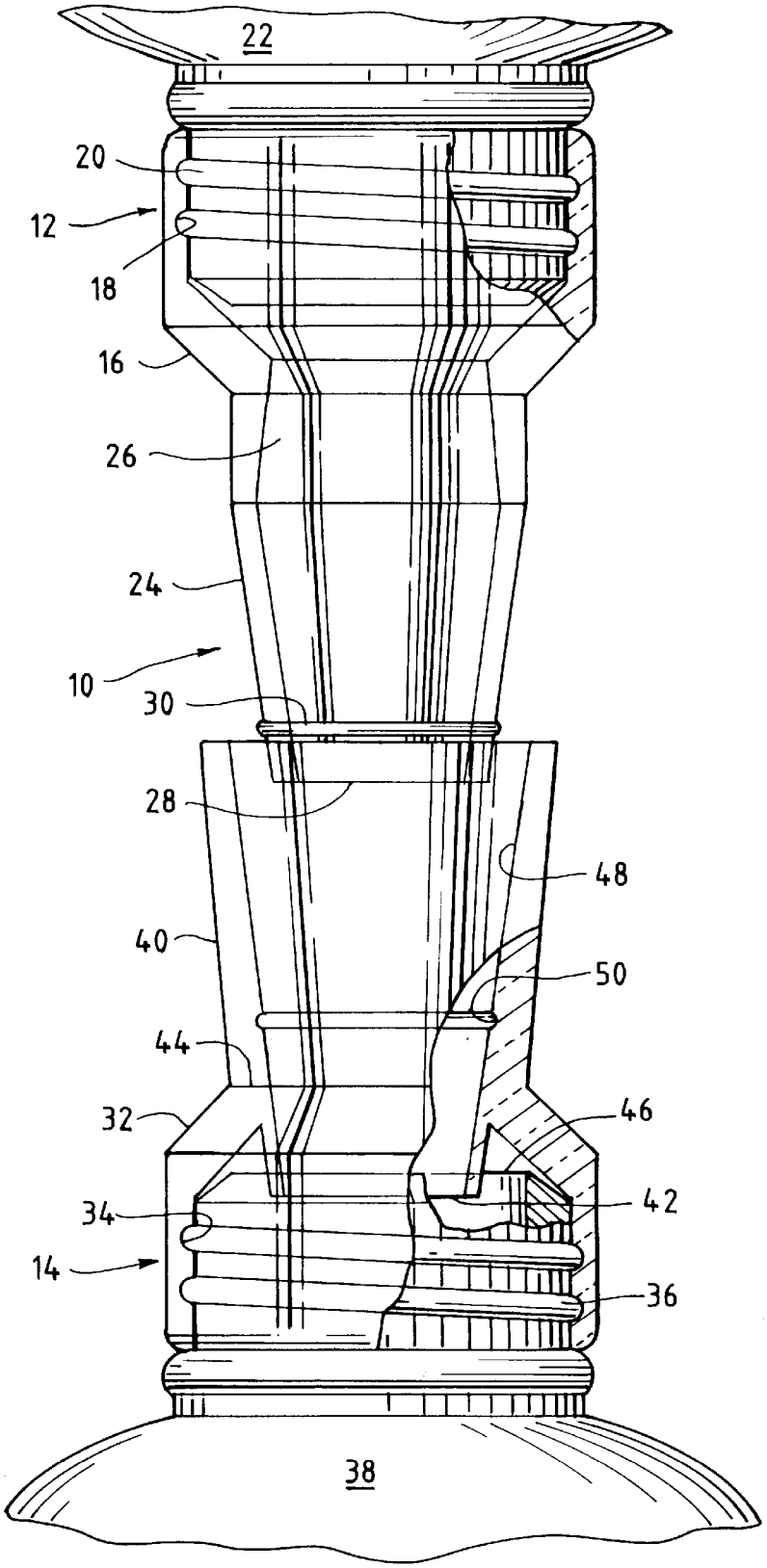
FIG. 1 is a frontal view of a liquid transfer system for bottles according to one embodiment of the present invention.

FIG. 1 shows a frontal view of one embodiment of a liquid transfer system for bottles 10 which includes a two piece mating liquid transferring tool including a first mating piece 12 and a second mating piece 14, respectively. The first mating piece 12 includes a bottle cap end portion 16 with internal conical threads 18 for screwing onto external conical threads 20 of a bottle 22 which is to be emptied of its liquid. The first mating piece 12 further includes a generally truncated cone shaped male end 24 integral with the cap end 16 having an axial passage 26 therethrough for passing liquids. At a predetermined distance from a tip 28 of the male end 24 is an annular rib 30 that is perpendicular to the axis of the truncated cone shaped male end 24.

The second mating piece 14 includes a bottle cap end portion 32 with internal conical threads 34 for screwing onto external conical neck threads 36 of a bottle 38 to be filled with the remnants of the liquid from bottle 22. The second mating piece 14 further includes a generally inverted truncated cone shaped female end 40 having its truncated end 42 extending down through a top 44 of the cap end 32 at a predetermined distance such that the truncated end 42 generally extends approximately below a rim opening 46 of bottle 38. An inner surface 48 of the truncated cone shaped female end 40 includes an annular locking groove 50 that is perpendicular to the axis of the inverted truncated cone shaped female end 40 and located at a predetermined distance on said inner surface 48.

When forming a fluid transferring passage between the first bottle 22 and the second bottle 38, the male end 24 of the first mating piece 12 is inserted into the female end 40 in an axial direction such that the rib 30 snaps and locks into the groove 50 in an friction engagement. Therefore, the male end 24 and female end 40 are dimensioned to frictionally and tightly engage one another during assembly to provide a snap and lock feature providing rigidity to the two piece liquid transferring tool when the pieces are assembled together for transferring liquids between two bottles. Thus, the male end 24 and female end 40 remain the same dimensions while their respective cap ends 16 and 32 can be sized to fit the neck threads of any size bottle. Generally speaking, six or seven different sized cap ends with corresponding threads to match for each mating piece 12 and 14 will permit the user to mix and match bottles of different sizes. The male and female ends of each mating piece 12 and 14, respectively, always remain the same dimensions permitting the assembly of the two pieces irrespective of their cap end size.

In operation, the user would generally screw the cap end 16 of the mating piece 12 onto the neck threads 20 of the bottle 22 until it is snuggly attached to the bottle 22. Next, the user would screw the cap end 32 of the mating piece 14 onto the neck threads of the bottle 38 until it is snuggly attached to the bottle 38. Then the user would tip the bottle 22 and align the axis of the male end 24 with the axis of the female end 40 and continuing inserting the male end 24 into the female end 40 until the rib 30 interlocks with the groove 50 within the female end 40. The remaining liquid in bottle 22 then drains by gravity into bottle 38 and since the tip 42 of the funnel shaped female end 40 is below the rim 46 of bottle 38, the liquid has no problem running down the side of the neck threads 36 on bottle 38 if that connection is not snug. In addition, the liquid transfer system for bottles is stable because the weight of the nearly full bottle is on the bottom with the nearly empty inverted bottle on top.

Figure 2:
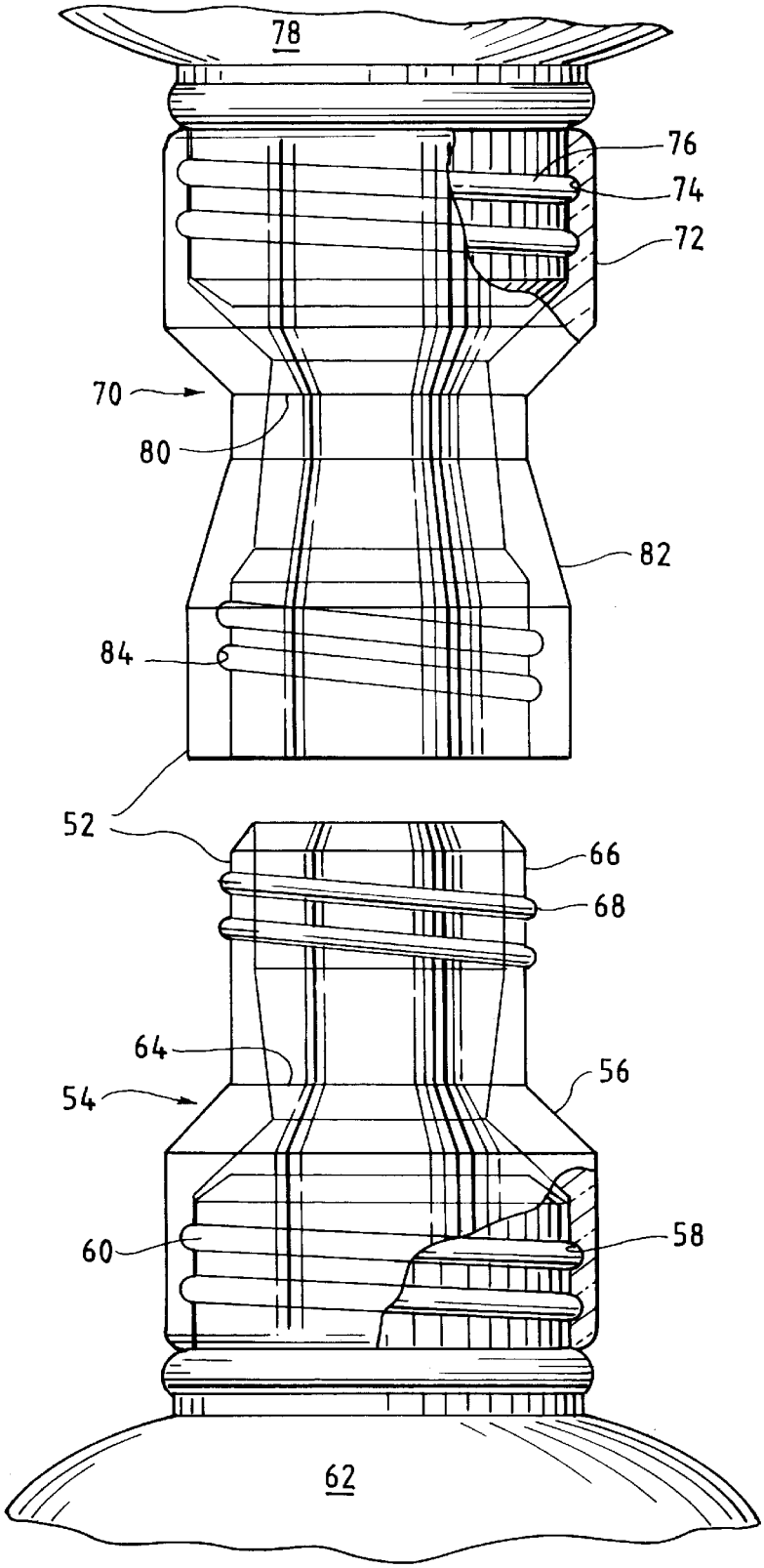
FIG. 2 is a frontal view of the liquid transfer system for bottles according to a second embodiment of the present invention.

Now referring to FIG. 2, a second embodiment of the invention is shown. This liquid transfer system for bottles includes a two piece construction 52 too. Again each piece includes a cap and either a male or female end attached thereto. A first piece 54 including a cap end 56 with internal conical threads 58 for screwing onto external conical neck threads 60 on a bottle 62. Connected to a top 64 of cap end 56 is an upwardly extending and generally truncated cone shaped male end 66 having an axial passage extending through both the center of the end cap 56 and male e nd 66 for transferring a liquid therethrough. The truncated male end 66 includes external conical threads 68 thereon. A second piece 70 includes a cap end 72 with internal conical threads 74 for screwing onto external conical neck threads 76 on a bottle 78. Connected to a top 80 of cap end 72 is a generally inverted truncated female end 82. On the interior of the female end 82 are internal conical threads 84 corresponding in size and dimension to the conical threads 68 on the male end 66.

In operation, the user screws the end cap 56 of mating piece 54 onto the neck of the bottle 62 until a snug fit is obtained. Next, the user screws the end cap 72 onto the neck of the bottle 78 to be connected to the bottle 62. Then the user axially aligns the male end 66 with the female end 82 and screws the male end 66 into the female end 82 until snuggly engaged. This assembly of the mating pieces 54 and 70 creates a rigid and stable assembly that permits the user to empty the contents of bottle 62 into bottle 78 by gravity feed.

Further, the liquid transfer tool can be made from a clear high-density polyethylene plastic material or any other similar material allowing the user to view the transfer of liquids without the material being reactive with the liquid being transferred.

Having described and illustrated the principles of the invention in a preferred embodiment and secondary embodiment thereof, it should be apparent that the invention can be modified in arrangement and detail without departing from the spirit and scope of the invention as claimed.

I claim:

1. A liquid transfer system for bottles comprising:

a two piece construction of a high density polyethylene plastic including a first piece having a cap end with internal conical threads for engaging external conical neck threads on a first bottle to be emptied and with a top, connected to the top of said cap end and extending upwardly therefrom a generally truncated cone shaped male end having an axial passage extending through the top of said cap end and male end for transferring a liquid therethrough, a second piece having a cap end with internal conical threads for engaging external conical neck threads on a second bottle to be filled by the first bottle and with a top, connected to the top of the cap end on the second piece is a generally inverted truncated female end having an axial passage extending through the top of said cap end and the female end, said male and female ends having means for axially mating the male and female ends together in a secure and tight fit so liquid from the first bottle to be emptied can be transferred by a gravity feed to the second bottle through the sealed axial passage formed by joining the first and second mating pieces together without spilling the liquid.

2. The liquid transfer system of claim 1, wherein the means for axially mating the male and female ends together includes external conical threads on the male end and internal conical threads on the female end corresponding to the male threads to screwingly engage the male and female ends together in a rigid and stable assembly.

3. The liquid transfer system of claim 1, wherein the means for axially mating the male and female ends together include an integral external annular rib located at a predetermined distance on the male end and an internal groove located at a predetermined distance within the axial passage of the female end whereby the axial insertion of the male end into the female end provides a sealable and snap locking action of the male rib into the female groove in a rigid and stable assembly so that liquid can flow from the first bottle into the second bottle without spillage.

4. The liquid transfer system of claim 3, wherein the inverted truncated female end extends through the top of cap end of the second mating piece a predetermined distance to form a funnel that extends below the rim of the second bottle to be filled when the cap end of the second mating piece is snuggly screwed to the neck threads of the second bottle.

5. A liquid transfer tool for bottles, comprising:

two mating pieces of a clear high-density polyethylene plastic material, a first piece with a bottle cap end for screwing onto the neck threads of a first bottle to be emptied and with a generally truncated cone shaped male end extending from the cap end including an integral annular exterior rib located a predetermined distance from the tip of the male end and a coaxial passage with the bottle cap end for transferring fluids therethrough, a second piece with a bottle cap end for screwing onto the neck threads of a second bottle to be filled with the remnants of the fluids from the first bottle and an inverted truncated female end extending upwardly from the bottle cap end in one direction and extending downwardly through the bottle cap like a funnel in the opposite direction below the rim of the second bottle, said female end including a locking groove located a predetermined distance within the female end for snap locking the rib of the first piece into the groove of the second piece for sealably transferring the liquid remnants from the first to second bottle in which the two mating pieces create a rigid and stable assembly for emptying the contents of the first bottle into the second bottle by gravity feed without spillage.

6. A liquid transfer tool for bottles containing various liquid foods, drugs and other household items, comprising:

two mating pieces of a clear high-density polyethylene plastic material for transferring liquids from one bottle to another having the same liquids therein without the material being reactive with the liquid being transferred, a first mating piece having a bottle cap end with internal conical threads for screwing onto the external conical threads on the neck of one bottle including a generally truncated cone shaped male end with external conical threads thereon and extending above the bottle cap end, said male end integral with the bottle cap end to form a coaxial passage through the cap end and male end, a second mating piece having a bottle cap end with internal conical threads for screwing onto external conical neck threads of another bottle to be joined to the one bottle including a generally inverted truncated female end extending above the bottle cap end having internal conical threads for screwingly engaging the male threaded end of the first piece to form a sealable pathway between the two bottles during the transfer of remnant fluids from the one bottle to the another bottle without spillage due to the rigid and stable assembly created by the two mating pieces.

7. A liquid transfer tool for bottles comprising:

a two piece construction including a first piece having a cap end with internal conical threads for engaging external conical neck threads on a first bottle to be emptied and with a top, connected to the top of said cap end and extending upwardly therefrom a generally truncated cone shaped male end having an axial passage extending through the top of said cap end and male end for transferring a liquid therethrough, a second piece having a cap end with internal conical threads for engaging external conical neck threads on a second bottle to be filled by the first bottle and with a top, connected to the top of the cap end on the second piece is a generally inverted truncated female end having an axial passage extending through the top of said cap end and the female end, said male and female ends having means for axially mating the male and female ends together in a secure and tight fit so liquid from the first bottle can be transferred to the second bottle through the sealed axial passage formed by joining the first and second mating pieces together without spilling the liquid, wherein the means for axially mating the male and female ends together include an external annular rib located at a predetermined distance on the male end and an internal groove located at a predetermined distance within the axial passage of the female end whereby the axial insertion of the male end into the female end provides a snap locking action of the male rib into the female groove so that liquid can flow from the first bottle into the second bottle without spillage, and wherein the inverted truncated female end extends through the top of cap end a predetermined distance to form a funnel that extends below the rim of the second bottle to be filled when the cap end of the second mating piece is snugly screwed to the neck threads of the second bottle.

* * * * *